US010081926B2

(12) United States Patent
Wood et al.

(10) Patent No.: US 10,081,926 B2
(45) Date of Patent: Sep. 25, 2018

(54) TRENCH WALL SUPPORT

(71) Applicant: EZE Shoring (Halifax) Limited, Leeds, Yorkshire (GB)

(72) Inventors: Glenn Roy Wood, Silsden (GB); Oliver Glenn Wood, Silsden (GB)

(73) Assignee: EZE Shoring (Halifax) Limited, Leeds (GB)

( * ) Notice: Subject to any disclaimer, the term of this patent is extended or adjusted under 35 U.S.C. 154(b) by 0 days.

(21) Appl. No.: 15/510,776

(22) PCT Filed: Sep. 17, 2015

(86) PCT No.: PCT/GB2015/052684
§ 371 (c)(1),
(2) Date: Mar. 13, 2017

(87) PCT Pub. No.: WO2016/042327
PCT Pub. Date: Mar. 24, 2016

(65) Prior Publication Data

US 2017/0254040 A1 Sep. 7, 2017

(30) Foreign Application Priority Data

Sep. 17, 2014 (GB) ..... 1416468.5

(51) Int. Cl.
*E02D 17/08* (2006.01)

(52) U.S. Cl.
CPC ..... *E02D 17/083* (2013.01)

(58) Field of Classification Search
CPC ..... E02D 17/08; E02D 17/04
USPC ..... 405/282, 283
See application file for complete search history.

(56) References Cited

U.S. PATENT DOCUMENTS

| | | | |
|---|---|---|---|
| 6,155,750 | A | 12/2000 | Wu et al. |
| 7,559,724 | B1 | 7/2009 | Olen |

FOREIGN PATENT DOCUMENTS

| | | | |
|---|---|---|---|
| DE | 2061255 | A1 | 6/1972 |
| DE | 2835948 | A1 | 2/1980 |
| DE | 80 17 079 | U1 | 9/1980 |
| FR | 2 296 057 | A1 | 7/1976 |
| FR | 2 297 957 | A1 | 8/1976 |
| JP | 7-102566 | A | 4/1995 |
| JP | 10-72828 | A | 3/1998 |
| JP | 1072828 | * | 3/1998 |
| WO | WO 0127395 | * | 4/2001 |

* cited by examiner

*Primary Examiner* — Sean D Andrish
(74) *Attorney, Agent, or Firm* — Blank Rome LLP

(57) ABSTRACT

The present invention relates to a support (20) for a prop (22). The prop (22) comprises a telescopic tube (26) and opposing transversely extending feet. The support (20) comprises a board (30) for contacting a support surface to transmit a supporting load thereto; a load bearing surface for receiving the supporting load from a prop (22); a bracket (32) coupled to the board (30), the bracket (32) arranged to support an end of the prop (22) at a load bearing position on the load bearing surface; and a guide for guiding the prop (22) to the load bearing position.

13 Claims, 4 Drawing Sheets

TRENCH WALL SUPPORT

TECHNICAL FIELD

The present invention relates to construction supports involving the use of a prop and a method of supporting such props. More particularly, the invention relates to a trench wall support and a method of supporting trench walls, in particular those trenches which have been excavated to access subterranean network structures.

BACKGROUND

Subterranean network structures are provided in suburban locations. These networks may include telecommunications network cables, or gas or water pipes laid beneath pavements or roads. Trenches are typically dug when installing or maintaining these networks. These trenches are typically 1-1.5 m wide, 1.5 m deep and several meters long. It is often desirable to provide support structures to prevent trench walls from collapsing or to prevent debris coming away from the trench wall and contaminating a maintenance site. In some geographical regions, these preventative measures may be compulsory depending on local building regulations.

One possibility for supporting a trench wall is with the use of an Acrow prop, or 'prop'. A prop includes a telescopic tube extending intermediate opposing feet extending generally transversely to the tube. Such props come in a range of sizes and a range of standard sizes. For example, a size 0 Acrow has a closed length of 1.04 m and an expanded length of 1.83 m. A size 4 Acrow has a closed length of 3.2 m and an open length of 4.88 m. A size 0 Acrow would be most desirable for use in supporting trench walls since the width of a trench is usually 1-1.5 m as described above.

In order to use the prop, a board is required to provide a load bearing surface for the prop and transmit a load exerted by the prop to a trench wall. Such an arrangement would require opposing boards each arranged to lie vertically against an opposing wall of the trench. This arrangement requires at least two personnel to perform various tasks for assembly. One person is required to erect opposing boards against the respective trench walls and then to hold a prop horizontally with opposing feet in the vicinity of each board. Another person is then required to extend the prop whilst the other holds it. Accordingly, even though the required equipment is simple and relatively cheap, the installation time and cost is unsatisfactory due to the number of people required.

One alternative mechanism which aims to address these problems includes two boards which are forced against opposing trench walls by a pair of pneumatic jacks. The pneumatic jacks are fixed to opposing end beams arranged to traverse the height of the trench walls to apply pressure across each board. This type of mechanism is pre-assembled and so also required more than one person to use since the size and shape of the mechanism is awkward for a single person to install. In addition, this type of pneumatic system is expensive, requires a pneumatic supply source for operation, and is rather complex.

It is an object of the present invention to address these problems and improve on the prior art.

SUMMARY OF THE INVENTION

According to a first aspect of the present invention there is provided a support for a prop, the prop comprising a telescopic tube extending between opposing transversely extending feet, the support comprising; a board for contacting a support surface to transmit a supporting load thereto; a load bearing surface for receiving the supporting load from a prop; a bracket coupled to the board, the bracket arranged to support an end of the prop at a load bearing position on the load bearing surface; and a guide for guiding the prop to the load bearing position.

The bracket serves to support an end of the prop so that fewer personnel are required. Specifically, the need for a person to hold the prop horizontally at a load bearing position, whilst another person extends the prop, has been removed. In addition, the bracket provides for improved accuracy in holding the prop at a desired load bearing position since the prop would inevitably move if a person where to hold it whilst the prop is being extended. The guide improves the ease of locating the prop at the load bearing position.

The bracket may comprise the guide. The guide being provided by the bracket removes the need for a separate component being required to guide the prop when moving it to the load bearing position.

The guide may be oriented to guide the tube downwards, in-use, to the load bearing position. The downwards orientation of the guide allows for gravity to assist in guiding the prop to the load bearing position.

The guide may be dimensioned so as to engage a tube of the prop. Engaging the tube as opposed to a foot of the prop provides for a more secure coupling arrangement between the guide and the prop due to the geometries associated with each part of the prop.

The bracket may comprise an overhang to accommodate a foot of the prop when guiding the tube to the load bearing position.

The guide may be formed as a slot formed from an edge of the overhang. A slot is a simple construction of the guide and also saves material.

The slot may be dimensioned for clearance fit with the tube. Clearance fit allows ease of installation and also removal of the tube in comparison to other fits such as interference fit.

The slot may be substantially U-shaped, wherein the bend of the U-shaped slot may form a seat to support the tube of the prop at the load bearing position.

The bend of the slot forms a positive engagement with a greater portion of the periphery of the tube in comparison to other shapes such as a flat end of a slot.

The bracket may comprise a plurality of tracks, each track may be arranged to direct the prop to an alternative load bearing position. Alternative load bearing positions allow for more flexibility for installation of the prop which is desirable since various obstacles may be present in the trench such as water pipes and gas pipes.

The tracks may have the same configuration as the slot. The same configuration provides for easy of manufacturing.

The tracks may be oriented in a direction including one or more of upwards, left, and right, in-use.

The tracks may be U-shaped slots, wherein the bend of each U-shaped slot may form a unique stop for limiting the respective alternative load bearing position to within predetermined limits on the load bearing surface.

Constraining the position of the alternative load bearing positions reduces the risk of the prop slipping off in-use which could occur if the prop was placed towards an exterior edge of the load bearing surface.

The edge of the overhang may be continuous and may also defines an access port for allowing a foot of the prop to pass for contacting the base plate, wherein the access port may define a central hub having each slot extending therefrom.

The central hub provides a single access point for the prop leading to improved repeatability of installation.

The edge may be dimensioned to permit passage of the foot in a first rotational position of the prop and dimensioned to prevent passage of the foot in a second rotational position of the prop.

Preventing the prop from being removed from the prop in the second rotational position means that the prop is held captive within the bracket unless specifically oriented for removal.

The support may further comprise a base plate mounted to the board, the base plate providing the load bearing surface.

The support may be made from a plastics material. Plastics materials are less prone to corrosion or decay than materials such as wood or metal which improves the longevity of the support considering the exposed environmental conditions in which the support will be used. In addition, some subterranean network components exhibit ignition risks and so plastic is desirable to prevent flame propagation.

The plastics material may be glass reinforced plastic (GRP). GRP is relatively strong and light weight in comparison to other plastics materials.

The support may be made by injection mounding so as to form a substantially monolithic structure. Being substantially monolithic is preferable to being made from several constituent components since the trench wall support is less likely to fall apart through wear and tear.

According to a further aspect of the present invention there is provided a trench support assembly comprising a prop and the aforementioned support.

According to a further aspect of the present invention there is provided a method of supporting a prop comprising;

- providing a support as described above;
- erecting the support against a support surface;
- guiding the prop to a load bearing position against the load bearing surface, using the guide;
- supporting an end of the prop at the load bearing position using the bracket; and
- extending the prop to exert a load on the load bearing surface.

According to a first aspect of the present invention there is provided a support for a prop, the prop comprising a telescopic tube extending between opposing transversely extending feet, the support comprising; a board for contacting a support surface to transmit a supporting load thereto; a load bearing surface for receiving the supporting load from a prop; a bracket coupled to the board, the bracket arranged to support an end of the prop at a load bearing position on the load bearing surface; and wherein the bracket comprises an overhang for accommodating the foot of the prop at the load bearing position to secure the foot to the bracket.

Within the scope of this application it is expressly intended that the various aspects, embodiments, examples and alternatives set out in the preceding paragraphs, in the claims and/or in the following description and drawings, and in particular the individual features thereof, may be taken independently or in any combination. Features described in connection with one embodiment are applicable to all embodiments, unless such features are incompatible.

BRIEF DESCRIPTION OF THE DRAWINGS

One or more embodiments of the invention will now be described, by way of example only, with reference to the accompanying drawings, in which.

DETAILED DESCRIPTION

Figure 1:
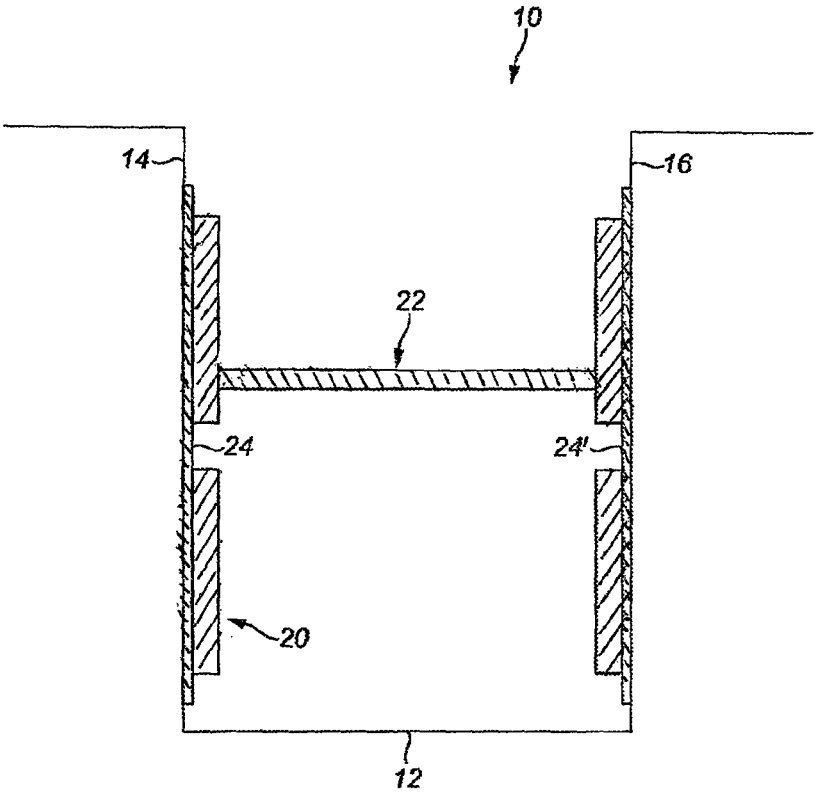
FIG. 1 shows a section view of a support for a prop according to an aspect of the present invention.

With reference to FIG. 1, according to a first embodiment, a trench 10 is dug by an arm of an excavator for performing maintenance on a subterranean network such as a telecommunication cable network or water or gas pipe network. The trench has a floor 12 and opposing left and right vertical walls 14, 16. The floor 12 is about 1.5 m wide. The walls 14, 16 are about 1.5 m in height. The trench is several meters in length.

A trench wall support assembly 20 is provided for supporting the walls 14, 16 of the trench to prevent them from collapsing or debris falling away and contaminating a work area. Accordingly, the trench wall 14, 16 are support surfaces since they require support. The trench wall support assembly 20 includes an Acrow prop 22, hereinafter 'prop', extending between a first support 24 and second support 24' to apply a force to the left wall 14 and the right wall 16 respectively. These supports 24, 24' are thus trench wall supports and will be described as such for the remainder of this embodiment.

Figure 2:
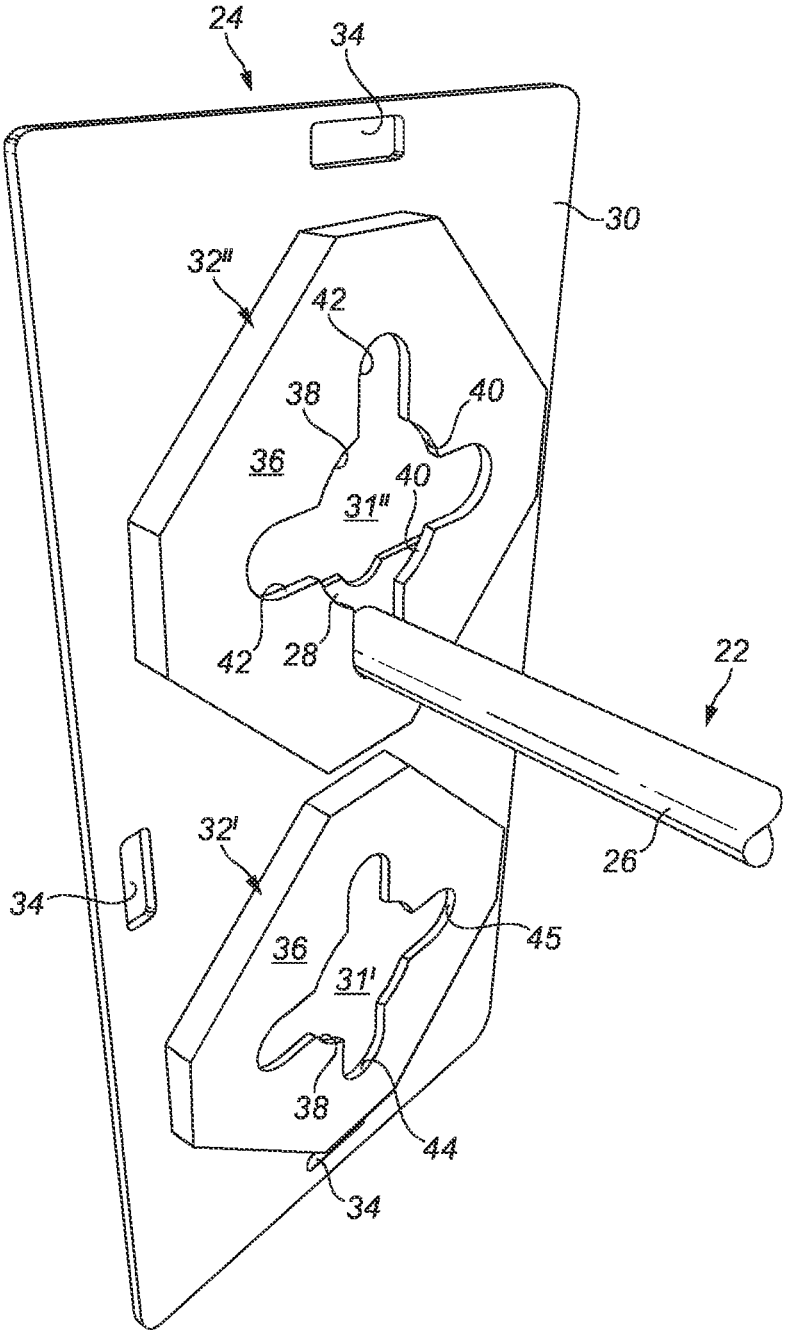
FIG. 2 shows a perspective view of a support structure from FIG. 1.

With reference to FIG. 2, the prop 22 is made from steel and includes a tube 26 and opposing feet 28 (only one foot shown for brevity). The tube 26 includes an inner tube and an outer tube. The length of each tube is around 1 m leading to a length range from between about 1 m and about 1.8 m. The tubes are threadingly engaged to provide continuous extension and retraction over the full length range. The outer diameter of the inner tube is about 48 mm and the outer diameter of the outer tube is about 60 mm.

The feet 28 are arranged at opposing ends of the tube 26 and extend substantially transversely therefrom. The feet 28 are formed from plates and are quadrilateral. More specifically, the feet 28 are formed as square plates being 150 mm in both length and width. The plates forming the feet are 6 mm thick.

The trench wall support 24 includes a board 30 for contacting a wall 14, 16 of the trench. The trench wall support 24 also includes first and second brackets 32', 32" and respective first and second base plates 31', 31" mounted to the board 30. The first and second brackets 32', 32" are arranged as lower and upper brackets 32', 32" when the board 30 is vertically oriented in a trench.

The board 30 is rectangular having a width of between 0.5 and 0.8 m and a length of 1 to 1.5 m or more preferably about 1.2 m. The board is approximately 10 mm thick. Four windows 34 are provided, one in the vicinity of each edge of the board 30. The windows each provide a handle allowing maintenance personnel to carry the board 30.

The base plate 31 provides a load bearing surface for the prop 22. The bracket 32 includes an overhang 36 suspended from around the entire peripheral edge of the base plate 31 and extending inwardly to an interior edge 38 formed as a cut-away portion of the overhang 36. The interior edge 38 is continuous and defines an access port in the form of a central hub 40. Four symmetrically arranged slots 42 extend substantially transversely away from the hub 40. The overhang 36 is in the form of a substantially planar panel being parallel to the base plate 31 which itself is substantially planar. The overhang 36 is spaced from the base plate 31 by between 8 and 12 mm, and preferably 10 mm, so as to provide a clearance fit for the foot. The clearance fit for the foot accommodates the foot 28 of the prop 22 moving in a transverse direction against the base plate 31.

The central hub is substantially circular having a diameter of less than 210 mm so as to be less than the diagonal extent of the foot of the prop 22. The diameter of the hub is between 160 and 180 mm, or more particularly 164 mm. The slots 42 have a width of about 64 mm. In this way the interior edge 38 is dimensioned to allow passage of the prop to the base plate 31 in a first rotational orientation, when the corners of the foot 28 are aligned with the slots 42, and dimensioned to prevent passage of the prop 22 in a second rotational orientation, when the sides of the foot 28 are aligned with the slots 42. Accordingly, the interior edge 38 serves to ensure the prop 22 remains captured by the bracket 32 unless the prop is in a specific (first) orientation.

The aforementioned dimensions may change in magnitude depending on the size of the prop 22 used with the present invention.

The slots 42 are linear. The slots 42 are separated by 90° from each other. One slot 42 points downwards, in-use and forms a guide for transversely guiding the prop during installation. The guide is substantially U-shaped and has a width of about 64 mm so as to be in clearance fit with the prop 22. The bend of the U-shaped slot 42 forms a seat 44. The seat 44 is for suspending one end of the prop 22 at a load bearing position on the base plate 31. The load bearing position is the position on the base plate 31 which receives a load exerted from a prop 22 when in an extended position biasing opposing trench wall supports 20 against opposing trench walls 14, 16. In this way, the bracket 32 is arranged to support one end of the prop 22 at the load bearing position on the base plate 31.

The other three slots are oriented horizontally to the left, horizontally to the right, and upwards. These other three slots 42 are of the same shape and size as the guide. The length between bend to bend of opposing slots 42 is between 300 and 320 mm, or more specifically, 310 mm. However the upwards, left and right slots 42 form tracks to direct movement of the prop 22. Each track is associated with a stop 45 arranged to constrain the transverse position of the prop 22 on the base plate 31. The stops 45 are formed from the respective bends of the U shaped slots 42. This is the same as the seat 44 however the stops 45 are termed differently to the seat 44 since the stops 45 are not provided for suspending an end of the prop 22 but constraining left, right, and upwards movement, in-use.

These tracks may be used in certain circumstances instead of the guide. For instance, these alternative load bearing positions may be used where obstacles are present in the trench, such as gas pipes or the like, in which case it may not be possible to use the load bearing position provided by the seat 44.

The trench wall support 24 is made from a plastics material. More specifically, the plastics material is glass reinforced plastic (GRP) due to its relatively high strength to weight ratio. The bracket 32 is integrally formed with the base plate 31 by injection molding so as to form a substantially monolithic structure. The base plate 31 may be friction welded onto the board 30. It is also possible to injection mold the board 30 as a monolithic structure with the base plate 31 and the base plate 31. In any case, the bracket 32 is coupled to the board. The bracket 32 is coupled to the board 30 indirectly by virtue of the base plate 31 being attached to the board 30. The plastics material minimizes corrosion which is common place with alternative materials such as wood or metal. In addition, some subterranean networks are associated with ignition sources so a plastics material is desirable in this case to prevent fire propagation.

With further reference to FIG. 1, in operation, a trench 10 is initially excavated by an arm of an excavator. Next, a trench wall support 24 and a second trench wall support 24' are provided. These support are erected by a person so as to engage the left and the right walls 14, 16 respectively. Next, the same person raises a prop 22 in a retracted configuration so as to fit between the trench wall supports 24, 24'.

Figure 3:
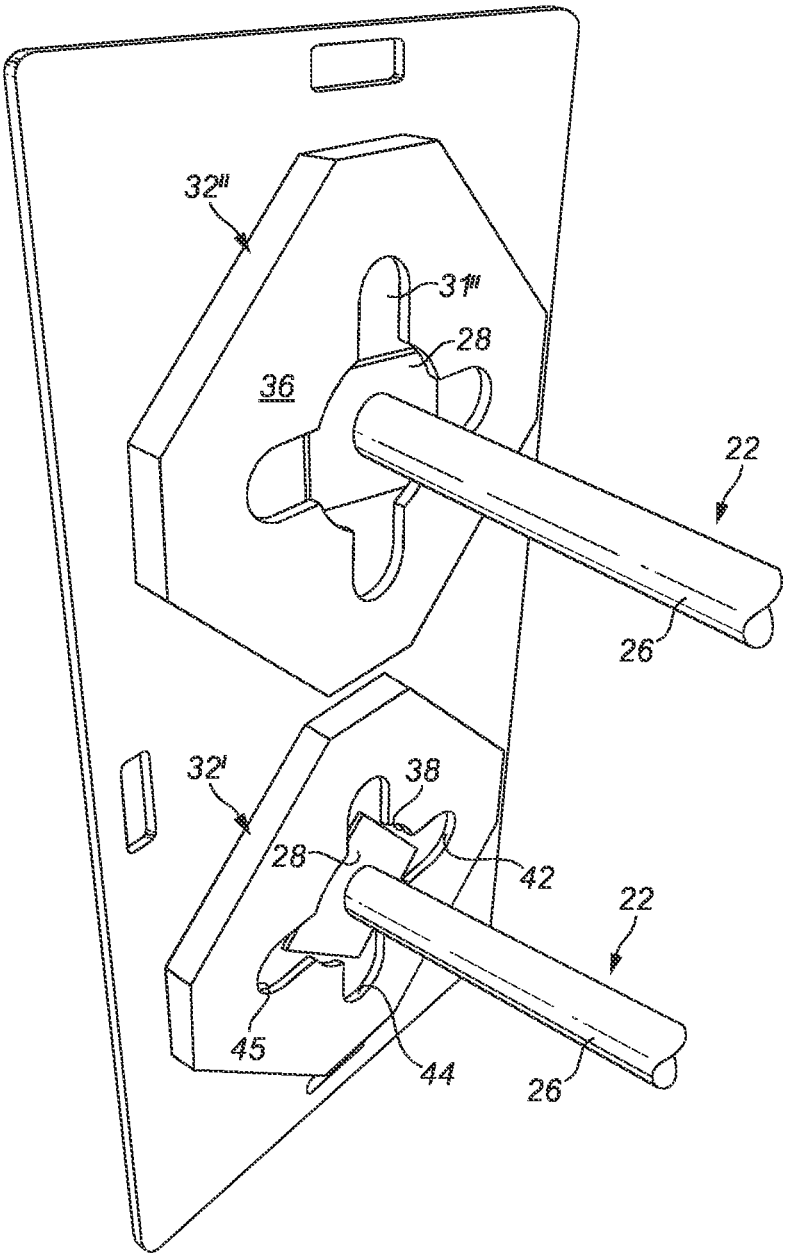
FIG. 3 shows a similar view to FIG. 2 showing the prop in different positions during assembly.

With reference to FIG. 3, the prop 22 is rotated about its longitudinal axis to the first rotational orientation. The prop shown against the lower bracket 32' is shown in the first rotational orientation. The prop is extended so that the feet 28 are in the vicinity of opposing base plates 31. The prop 22 is allowed to pass through to the base plate 31 since the corners of the feet 28 are aligned with the slots 42.

Next the prop 22 is rotated about its central axis to the second rotational orientation whereby the corners of the feet 28 are no longer aligned with the slots 42. The second rotational orientation of the prop 22 is shown against the upper bracket 32".

With further reference to FIG. 2, the prop 22 is then lowered. The lower slot 42, or guide, guides the prop 22 downwards towards the load bearing position. The prop 22 reaches the load bearing position when the tube 26 contacts the seat 44. In this way, further downwards motion is prevented beyond the lower operating position. The prop 22 is now supported by the bracket 32 and thus suspended since downwards forces such as gravity cannot move the prop 22 downwards any further. Accordingly the person assembling the trench wall support assembly can release the prop 22 and attend to extending the length of the prop 22 further so as to contact opposing base plates 31. In this way, the base plates 31 provide load bearing surfaces for the prop 22 to apply a load to the boards 30. The boards 30 transmit the load the walls 14, 16 to support them and prevent them from collapsing or debris from falling off into a work area. In this way the load transmitted to the wall is a supporting load.

There is thus not requirement for additional people for assembling the trench support assembly due to the provision of the opposing brackets 32 for supporting opposing ends of the prop 22.

Various alternative embodiments are envisaged without departing from the scope of the subsequent claims. For instance, in a second embodiment, the support structure has uses other than supporting trench walls 14, 16. One other use is on a construction site where a prop 22 is oriented vertically to support a suspended structure such as a doorway arch. No additional figure is provided to show this second use embodiment since the support 24 is the same and the only difference is the orientation.

In such an embodiment, a floor of the building would provide the support surface for contacting the board 30 of the support 24. This is different to the trench walls 14, 16 being the support surface since a floor would act to support the prop 22 as opposed to being supported thereby. Regardless, both the floor and the trench walls 14, 16 are considered to be support surfaces.

When the prop 22 is used to support a doorway arch, or other suspended structure, the board 30 of the support 24 is placed onto a floor. The floor acts to support the prop 22 and is thus a support surface. The prop 22 is oriented in the first rotational orientation so as to pass through the access port.

When the foot 28 of prop contacts the load bearing surface, provided by the base plate 31, the prop 22 may be rotated to be in the second rotational position and thus captured by the overhang 26. The prop 22 can then be guided along the guide to until the tube 26 contacts the seat 44. At this point the, prop 22 is at a load bearing position on the load bearing surface. The prop tube 26 can then be extended in length until the opposing foot contacts the doorway arch, or other suspended structure. The prop 22 exerts a supporting load to the load bearing surface when a compressive load is exerted onto the prop by the doorway arch. The seat 44 at this point serves to minimise the risk of the prop 22 being knocked sideways from an external force, in-use. In order to further minimise such a risk of knocking the prop 22 sideways, bolts may be passed through the windows 34 and screwed into the floor. Alternatively, bolt holes may be provided on the board 30 for this purpose.

Figure 4:
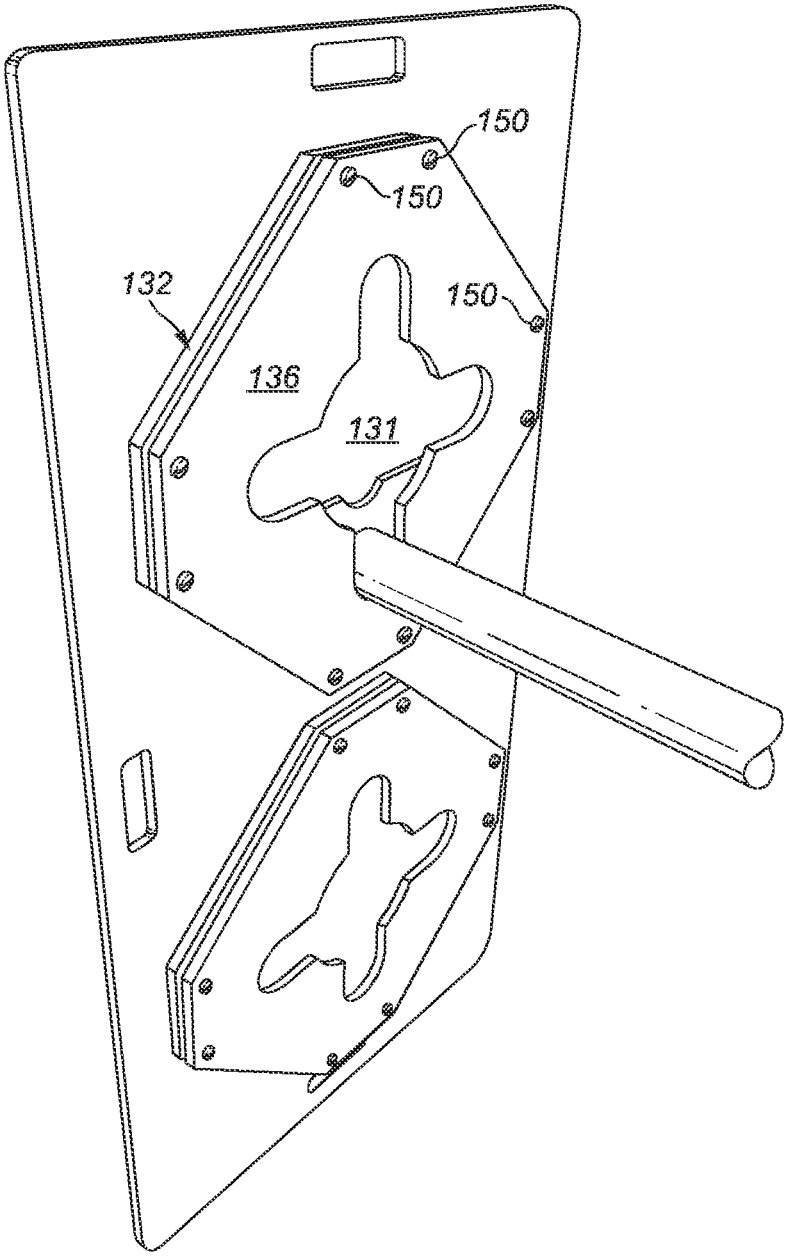
FIG. 4 shows a similar view to FIG. 2 showing a support according to an alternative embodiment of the present invention.

Various structural alternatives are possible too. With reference to FIG. 4, the base plate 131 may be fixed to a parallel panel forming the overhang 136. The base plate 131 and overhang 136 in such an arrangement are connected together by fasteners 150 such as bolts 150 around the periphery of each component.

The invention claimed is:

1. A trench wall support, comprising;

a board for contacting a support surface to transmit a supporting load thereto;

a load bearing surface for receiving the supporting load from a prop, the prop comprising a telescopic tube extending between opposing transversely extending feet;

a bracket coupled to the board, the bracket arranged to support an end of the prop at a load bearing position on the load bearing surface;

wherein the bracket comprises a guide for guiding the prop to the load bearing position;

wherein the bracket comprises an overhang to accommodate one of the feet of the prop when guiding the tube to the load bearing position;

wherein the guide is formed as a slot formed from an edge of the overhang and dimensioned so as to engage said telescopic tube of the prop, with an end of said telescopic tube adjacent one of the feet of the prop positioned within the slot; wherein the bracket comprises a plurality of tracks, each track arranged to direct the prop to an alternative load bearing position; and wherein the tracks have the same configuration as the slot; and wherein the edge of the overhang is continuous and also defines an access port for allowing said one of the feet of the prop to pass for contacting the load bearing surface, wherein the access port defines a central hub having the slot and each track extending therefrom.

2. The trench wall support of claim 1 wherein the guide is oriented to guide the tube downwards, in-use, to the load bearing position.

3. The trench wall support of claim 1, wherein the slot is dimensioned for clearance fit with the tube.

4. The trench wall support of claim 1, wherein the slot is substantially U-shaped, wherein the bend of the U-shaped slot forms a seat to support the tube of the prop at the load bearing position.

5. The trench wall support of claim 1, wherein the tracks are oriented in a direction including one or more of upwards, left, and right, in-use.

6. The trench wall support of claim 1, wherein the tracks are U-shaped slots, wherein the bend of each U-shaped slot of the tracks forms a unique stop for limiting the respective alternative load bearing position to within predetermined limits on the load bearing surface.

7. The trench wall support of claim 1, wherein the edge is dimensioned to permit passage of one of the feet in a first rotational position of the prop and dimensioned to prevent passage of said one of the feet in a second rotational position of the prop.

8. The trench wall support of claim 1, further comprising a base plate mounted to the board, the base plate providing the load bearing surface.

9. The trench wall support of claim 1, made from a plastics material.

10. The trench wall support of claim 9, wherein the plastics material is glass reinforced plastic (GRP).

11. The trench wall support of claim 9 being made by injection molding so as to form a substantially monolithic structure.

12. A trench support assembly comprising the trench wall support of claim 1, and the prop.

13. A method of supporting a prop comprising;

providing the trench support assembly of claim 12;

erecting the support against a support surface;

guiding the prop to a load bearing position against the load bearing surface, using the guide;

supporting an end of the prop at the load bearing position using the bracket; and extending the prop to exert a load to the load bearing surface.

* * * * *